US007975334B1

(12) United States Patent
Vensel

(10) Patent No.: US 7,975,334 B1
(45) Date of Patent: Jul. 12, 2011

(54) BEDDING SYSTEM

(76) Inventor: Evangelia Vensel, Spokane, WA (US)

( * ) Notice: Subject to any disclaimer, the term of this patent is extended or adjusted under 35 U.S.C. 154(b) by 0 days.

(21) Appl. No.: 12/728,091

(22) Filed: Mar. 19, 2010

(51) Int. Cl.
*A47G 9/04* (2006.01)

(52) U.S. Cl. ..... 5/498; 5/494; 5/496; 5/484; 5/485

(58) Field of Classification Search ..... 5/484, 485, 5/494–498
See application file for complete search history.

(56) References Cited

U.S. PATENT DOCUMENTS

| | | | | | |
|---|---|---|---|---|---|
| 3,530,487 | A * | 9/1970 | Beer | ..... | 5/496 |
| 3,857,124 | A * | 12/1974 | Hadley | ..... | 5/496 |
| 4,546,508 | A * | 10/1985 | Ison | ..... | 5/494 |
| 5,099,531 | A * | 3/1992 | Schmier | ..... | 5/692 |
| 5,208,927 | A * | 5/1993 | Lachmar | ..... | 5/497 |
| 5,701,617 | A * | 12/1997 | Colby | ..... | 5/484 |
| 6,044,503 | A * | 4/2000 | McClendon | ..... | 5/482 |
| 6,049,925 | A * | 4/2000 | Lewis | ..... | 5/497 |
| 6,098,219 | A * | 8/2000 | Milber | ..... | 5/494 |
| 6,859,962 | B2 * | 3/2005 | Diak/Ghanem | ..... | 5/499 |
| 7,086,102 | B1 * | 8/2006 | Frazier | ..... | 5/502 |
| 7,103,929 | B2 * | 9/2006 | Pilling et al. | ..... | 5/487 |

* cited by examiner

*Primary Examiner* — Michael Trettel

(57) ABSTRACT

Implementations for a bedding system are generally disclosed.

20 Claims, 3 Drawing Sheets

BEDDING SYSTEM

BACKGROUND

Bedding items, such as sheets, comforters, and the like come in various sizes and shapes. Such bedding items may coupled to a mattress in a variety of ways. For example, such bedding items may be designed to be fit snug around the corners of a mattress (e.g. "fitted sheets"), designed to be tucked in and/or folded around the corners of a mattress (e.g. "flat sheets"), or simply placed on top of the mattress to hang down over the sides of the mattress.

BRIEF DESCRIPTION OF THE DRAWINGS

Embodiments are illustrated by way of example and not by way of limitation in the figures of the accompanying drawings, in which like references may indicate similar elements and in which.

DETAILED DESCRIPTION

In the following description, various embodiments will be disclosed. However, it will be apparent to those skilled in the art that the embodiments may be practiced with all or only some of the disclosed subject matter. For purposes of explanation, specific numbers and/or configurations are set forth in order to provide a thorough understanding of the embodiments. However, it will also be apparent to one skilled in the art that the embodiments may be practiced without one or more of the specific details, or with other approaches and/or components. In other instances, well-known structures and/or operations are not shown or described in detail to avoid obscuring the embodiments. Furthermore, it is understood that the embodiments shown in the figures are illustrative representations and are not necessarily drawn to scale.

Figure 1:
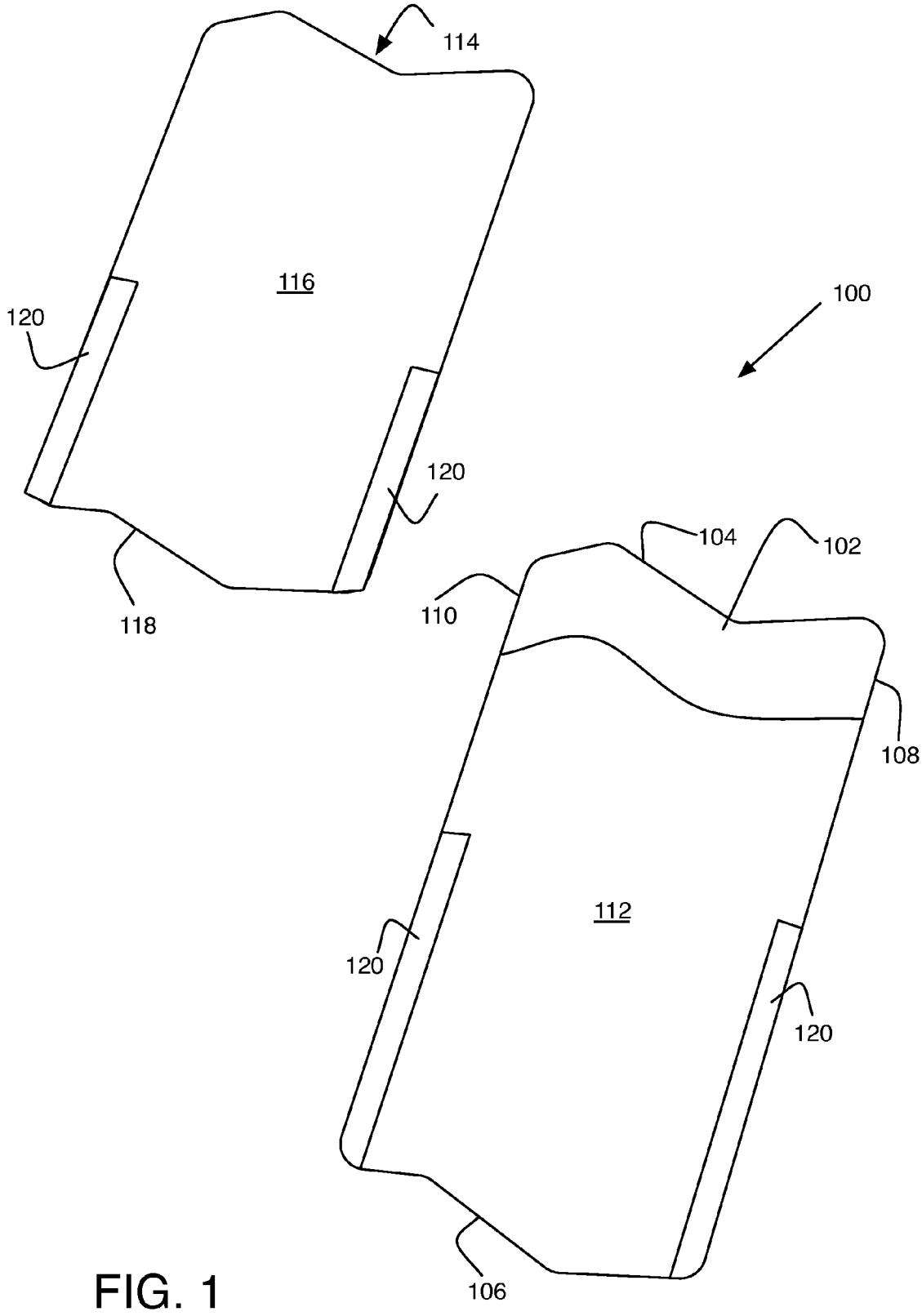
FIG. 1 illustrates an exploded top perspective view of an example bedding system.

FIG. 1 illustrates an exploded top perspective view of an example bedding system, in accordance with at least some embodiments of the present disclosure. As illustrated, bedding system 100 may include a bottom sheet 102. The bottom sheet 102 may include a top edge 104, a bottom edge 106, and two side edges 108, 110. As illustrated, the bottom sheet 102 may be a flat sheet sized to fit over a top, sides and at least a portion of a bottom of a mattress.

Figure 3:
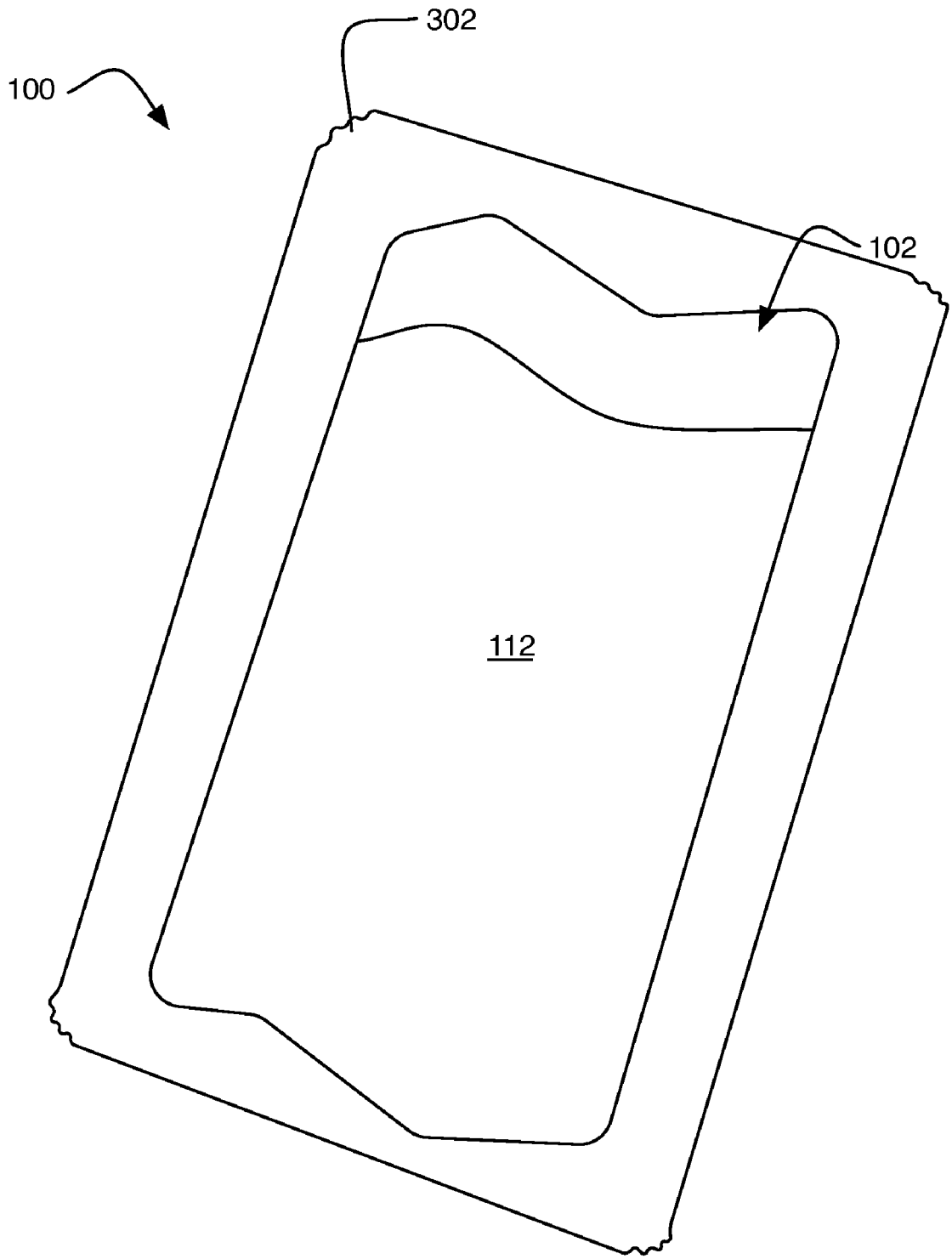
FIG. 3 illustrates a perspective view of an example bedding system.

FIG. 3 illustrates a perspective view of an example bedding system, in accordance with at least some embodiments of the present disclosure. As illustrated, the bottom sheet 102 may be a fitted sheet sized to fit over a top, sides and at least a portion of a bottom of a mattress (not shown). For example, bottom sheet 102 may include a fitted portion 302 configured to fit over at least a portion of a bottom of a mattress (not shown).

Referring back to FIG. 1, the bedding system 100 may include a top sheet 112 that may be fixedly coupled to the bottom sheet 102. For example, top sheet 112 that may be fixedly coupled to the bottom edge 106 of the bottom sheet 102.

Additionally or alternatively, top sheet 112 that may be fixedly coupled to at least a portion of the two side edges 108, 110 of the bottom sheet 102. The top sheet 112 may be sized shorter than the bottom sheet 102 in a longitudinal direction so as to leave a portion of the bottom sheet 102 adjacent the top edge 104 uncovered by the top sheet 112.

The bedding system 100 may include a comforter 114. The comforter 114 may be sized shorter than the bottom sheet 102 in a longitudinal direction so as to leave a portion of the bottom sheet 102 adjacent the top edge 104 uncovered by the comforter 114. Additionally or alternatively, the comforter 114 may be a reversible comforter configured to have two opposing flat surfaces 116, 118 that are both adapted to be an outermost surface of bedding system 100 when assembled with a mattress (not shown).

The bedding system 100 may include a matable fastener 120 removably coupled between the top sheet 112 and the comforter 114. As illustrated, the matable fastener 120 may be a hook/loop-type matable fastener. Alternatively, the matable fastener 120 may be a button/hole-type matable fastener, a zipper-type matable fastener, or a snap-type matable fastener.

In examples where the comforter 114 is a reversible comforter having first and second flat surfaces 116, 118, the matable fastener 120 may be configured to couple between the top sheet 112 and the first flat surface 116 of the comforter 114. Additionally, the matable fastener 120 may be configured to couple between the top sheet 112 and the second flat surface 118 of the comforter 114. For example, matable fastener 120 on comforter 114 may include hole-type matable fasteners that extend through both flat surfaces 116, 118 of comforter 114.

Alternatively, in examples where the comforter 114 is a reversible comforter having first and second flat surfaces 116, 118, the matable fastener 120 matable fastener may include a first portion configured to only couple between the top sheet 112 and the first flat surface 116 of the comforter 114 and may include a second portion configured to only couple between the top sheet 112 and the second flat surface 118 of the comforter 114. For example, matable fastener 120 on comforter 114 may include a first set of loop-type matable fasteners associated with flat surface 116 and may include a second set of loop- type matable fasteners associated with flat surface 118 of comforter 114.

In operation, a user (not shown) may associate bottom sheet 102 with a mattress (not shown). The top sheet 112 may be secured via the top sheet's 112 coupling to bottom sheet 102, as opposed or in addition to being fit over at least a portion of a bottom of a mattress (not shown). Similarly, the comforter 114 may be secured via matable fastener 120 removably coupled between the top sheet 112 and the comforter 114, as opposed or in addition to being fit over at least a portion of a bottom of a mattress (not shown).

Figure 2:
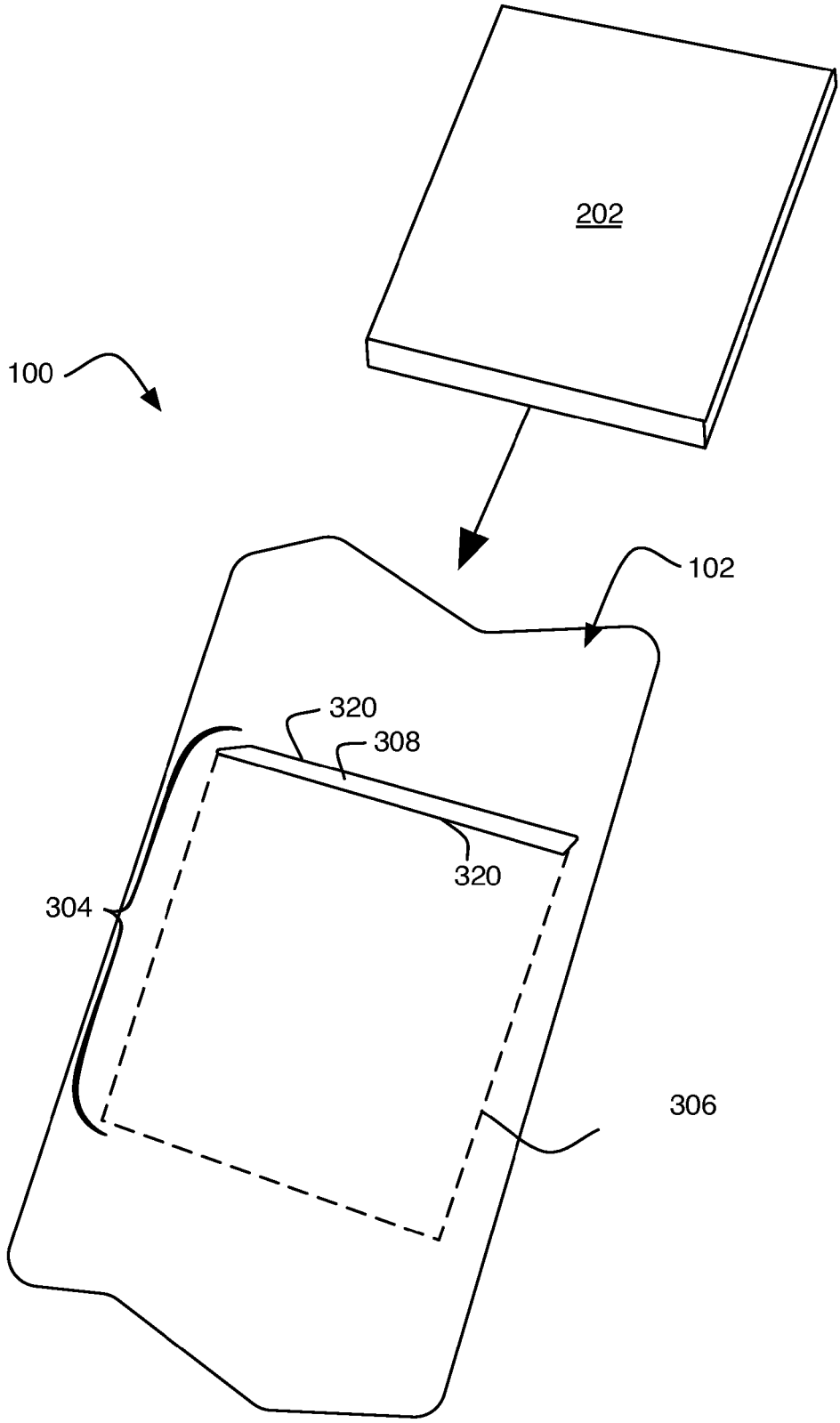
FIG. 2 illustrates an exploded bottom perspective view of an example bedding system.

FIG. 2 illustrates an exploded bottom perspective view of an example bedding system, in accordance with at least some embodiments of the present disclosure. As illustrated, the bedding system 100 may include a urine absorbent pad 202. The bedding system 100 may also include a pocket 304. The pocket 304 may include a pouch portion 306 fixedly coupled to the bottom sheet 102 and an opening portion 308. The pouch portion 306 of the pocket 304 may be configured to removably contain the urine absorbent pad 202. A matable fastener 320 may be removably coupled between the opening portion 308 of the pocket 304 and the bottom sheet 102. As illustrated, the matable fastener 320 may be a hook/loop-type matable fastener. Alternatively, the matable fastener 320 may be a button/hole-type matable fastener, a zipper-type matable fastener, or a snap-type matable fastener.

References throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner. Various operations may be described as multiple discrete steps in turn, in a manner that is most helpful in understanding the claimed subject matter. However, the order of description should not be construed as to imply that these operations are necessarily order dependent.

While there has been illustrated and/or described what are presently considered to be example embodiments, it will be understood by those skilled in the art that various other modifications may be made, and/or equivalents may be substituted, without departing from the true scope of claimed subject matter. Additionally, many modifications may be made to adapt a particular situation to the teachings of claimed subject matter without departing from subject matter that is claimed. Therefore, it is intended that the patent not be limited to the particular embodiments disclosed, but that it covers all embodiments falling within the scope of the appended claims.

What is claimed is:

1. A bedding system, comprising:

a bottom sheet, the bottom sheet having a top edge, a bottom edge, and two side edges;

a top sheet fixedly coupled to the bottom edge of the bottom sheet and fixedly coupled to at least a portion of the two side edges of the bottom sheet;

a comforter;

a matable fastener removably coupled between the top sheet and the comforter;

a urine absorbent pad;

a pocket, the pocket having a pouch portion fixedly coupled to the bottom sheet and an opening portion, wherein the pouch portion of the pocket is configured to removably contain the urine absorbent pad; and a second matable fastener removably coupled between the opening portion of the pocket and the bottom sheet.

2. The bedding system of claim 1, wherein the bottom sheet is a fitted sheet sized to fit over a top, sides and at least a portion of a bottom of a mattress.

3. The bedding system of claim 1, wherein the bottom sheet is a flat sheet sized to fit over a top, sides and at least a portion of a bottom of a mattress.

4. The bedding system of claim 1, wherein the top sheet is sized shorter than the bottom sheet in a longitudinal direction so as to leave a portion of the bottom sheet adjacent the top edge uncovered by the top sheet.

5. The bedding system of claim 1, wherein the comforter is sized shorter than the bottom sheet in a longitudinal direction so as to leave a portion of the bottom sheet adjacent the top edge uncovered by the comforter.

6. The bedding system of claim 1, wherein the comforter is a reversible comforter.

7. The bedding system of claim 1, wherein the comforter is a reversible comforter having first and second flat surfaces, and wherein the matable fastener is configured to couple between the top sheet and the first flat surface of the comforter and is configured to couple between the top sheet and the second flat surface of the comforter.

8. The bedding system of claim 1, wherein the comforter is a reversible comforter having first and second flat surfaces, and wherein the matable fastener comprises a first portion configured to only couple between the top sheet and the first flat surface of the comforter and comprises a second portion configured to only couple between the top sheet and the second flat surface of the comforter.

9. A bedding system, comprising:

a bottom sheet, the bottom sheet having a top edge, a bottom edge, and two side edges;

a top sheet fixedly coupled to the bottom edge of the bottom sheet and fixedly coupled to at least a portion of the two side edges of the bottom sheet;

a comforter; and a matable fastener removably coupled between the top sheet and the comforter, wherein the comforter is a reversible comforter having first and second flat surfaces, and wherein the matable fastener is configured to couple between the top sheet and the first flat surface of the comforter and is configured to couple between the top sheet and the second flat surface of the comforter.

10. The bedding system of claim 9, wherein the bottom sheet is a fitted sheet sized to fit over a top, sides and at least a portion of a bottom of a mattress.

11. The bedding system of claim 9, wherein the bottom sheet is a flat sheet sized to fit over a top, sides and at least a portion of a bottom of a mattress.

12. The bedding system of claim 9, wherein the top sheet is sized shorter than the bottom sheet in a longitudinal direction so as to leave a portion of the bottom sheet adjacent the top edge uncovered by the top sheet.

13. The bedding system of claim 9, wherein the comforter is sized shorter than the bottom sheet in a longitudinal direction so as to leave a portion of the bottom sheet adjacent the top edge uncovered by the comforter.

14. The bedding system of claim 9, wherein the matable fastener is a zipper-type matable fastener, a button/hole-type matable fastener, a hook/loop-type matable fastener, or a snap-type matable fastener.

15. The bedding system of claim 9, further comprising:

a urine absorbent pad;

a pocket, the pocket having a pouch portion fixedly coupled to the bottom sheet and an opening portion, wherein the pouch portion of the pocket is configured to removably contain the urine absorbent pad; and a second matable fastener removably coupled between the opening portion of the pocket and the bottom sheet.

16. The bedding system of claim 9, further comprising:

a urine absorbent pad;

a pocket, the pocket having a pouch portion fixedly coupled to the bottom sheet and an opening portion, wherein the pouch portion of the pocket is configured to removably contain the urine absorbent pad; and a second matable fastener removably coupled between the opening portion of the pocket and the bottom sheet, wherein the second matable fastener is a zipper-type matable fastener, a button/hole-type matable fastener, a hook/loop-type matable fastener, or a snap-type matable fastener.

17. A bedding system, comprising:

a bottom sheet, the bottom sheet having a top edge, a bottom edge, and two side edges;

a top sheet fixedly coupled to the bottom edge of the bottom sheet and fixedly coupled to at least a portion of the two side edges of the bottom sheet;

a comforter; and a matable fastener removably coupled between the top sheet and the comforter, wherein the comforter is a reversible comforter having first and second flat surfaces, and wherein the matable fastener comprises a first portion configured to only couple between the top sheet and the first flat surface of the comforter and comprises a second portion configured to only couple between the top sheet and the second flat surface of the comforter.

18. The bedding system of claim 17, wherein the bottom sheet is a fitted sheet sized to fit over a top, sides and at least a portion of a bottom of a mattress.

19. The bedding system of claim 17, wherein the bottom sheet is a flat sheet sized to fit over a top, sides and at least a portion of a bottom of a mattress.

20. The bedding system of claim 1, wherein the matable fastener is a button/hole-type matable fastener and wherein the second matable fastener is a a hook/loop-type matable fastener.

* * * * *